US005992183A

United States Patent [19]

Shima

[11] Patent Number: 5,992,183

[45] Date of Patent: Nov. 30, 1999

[54] FLAT KNITTING MACHINE

[75] Inventor: Masahiro Shima, Wakayama, Japan

[73] Assignee: Shima Seiki Manufacturing, Ltd., Wakayama, Japan

[21] Appl. No.: 09/131,877

[22] Filed: Aug. 10, 1998

[30] Foreign Application Priority Data

Aug. 8, 1997 [JP] Japan ..... 9-214613

[51] Int. Cl.[6] ..... D04B 7/00

[52] U.S. Cl. ..... 66/64; 66/78

[58] Field of Search ..... 66/60 R, 64, 78, 66/62, 68, 70, 71, 74, 75.1, 76, 77

[56] References Cited

U.S. PATENT DOCUMENTS

| | | | |
|---|---|---|---|
| 4,474,037 | 10/1984 | Kühnert | 66/78 |
| 4,555,917 | 12/1985 | Kuhnert | 66/78 |
| 4,637,227 | 1/1987 | Shima | 66/78 |
| 4,637,228 | 1/1987 | Shima | 66/78 |

FOREIGN PATENT DOCUMENTS

| | | | |
|---|---|---|---|
| 449549 | 10/1991 | European Pat. Off. | 66/78 |
| 2143855 | 12/1985 | United Kingdom | 66/78 |

*Primary Examiner*—Peter Nerbun
*Assistant Examiner*—Larry D. Worrell, Jr.
*Attorney, Agent, or Firm*—Nikaido, Marmelstein, Murray & Oram LLP

[57] ABSTRACT

A compound needle, of which slider and needle body can be moved forward and backward independently of each other, is guided by a cam lock into four routes, knit, tuck, transfer and receiving. As for the slider, the knit route is branched from the tuck route, and branching from the tuck route to the transfer route is made by a movable cam at the center of the cam lock. As for the needle body, the knit route is branched from the tuck route to reach the knit level then joining the tuck route. The transfer route is branched from the knit route and the needle body is retracted to a point between the tuck level and an inactive position, and the receiving route advances the needle body from the center of the cam lock to the tuck level.

5 Claims, 18 Drawing Sheets

FIG. 4
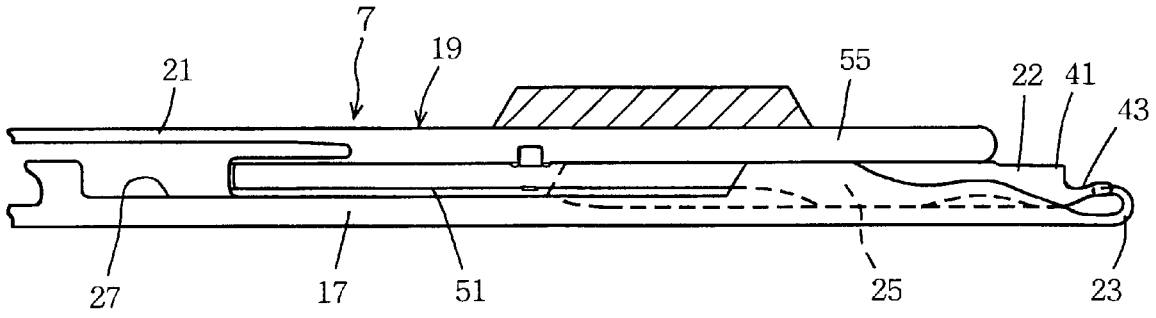
FIG. 6-a
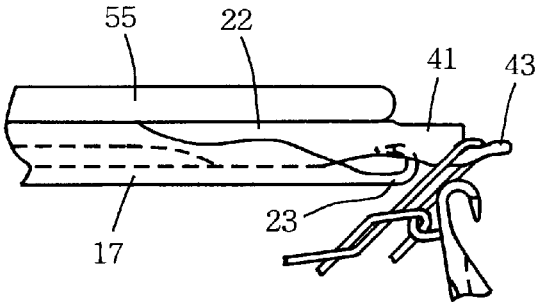
FIG. 6-b
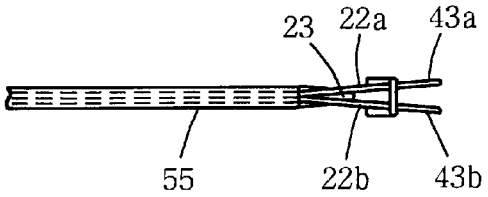

FLAT KNITTING MACHINE

FIELD OF THE INVENTION

The present invention relates to a flat knitting machine that uses compound needles, said compound needle comprising a slider, that includes two blades having a tongue at the head thereof, and a needle body, and in particular, relates to a compound cam system thereof.

In the present specification, with regard to the actions of the compound needles, cam locks, etc., the longitudinal direction of the compound needle mounted in a needle groove is defined as the forward/backward direction or advancement/retraction direction, and the trick gap side is the front and the other side is the back. A direction perpendicular to the surface of a needle bed is the upward/downward direction or high/low direction.

PRIOR ART

The compound needle of the above-mentioned type and the cam system thereof are disclosed in Japanese Patent SHO 62-19535 (German Patent P3220055), etc. In this patent, cam units of the carriage are arranged symmetrically about the center line, and the cam unit has a needle body cam lock, that engages with the needle butt to control the needle body, and a slider cam lock, that is arranged on the trick gap side of the needle body cam lock and engages with the slider butt to control the slider. These cam locks are composed of stitch cams, that are composed of movable cams and fixed cams, said movable cam working together with needle selection means to effect a swing at the reversing point of the carriage, movable cams arranged at the center for transfer, and fixed slider cams. Moreover, slider grooves are formed in the slider cam lock, and needle selection means are provided on the center line of the cam lock and on both ends thereof. With this arrangement, the cam system enables formation of stitch loops of knit and tuck and transfer in each direction of the carriage.

As is the case with the cam system of the conventional flat knitting machine, in the cam system according to the present invention, the tuck route and the knit route join on this side of the stitch cam. On this side of the joining point, the hook of the knit route protrudes into the trick gap more than the hook of the tuck route, thus the yarn feeder must be located between the joining point and the stitch cam. Because of this, the yarn has a steep incline to the horizontal plane, and the yarn condition gets worse for the compound needle for which yarn catching is more difficult since its advancement/retraction stroke is small.

Next, the inventor examined the problem of transfer for the compound needle. At the time of transfer, the needle bed is sometimes racked while a stitch loop is kept on tongues of a slider. The inventor found that in such a case as a force was exerted to the tongues, the tongues could be bent sidewise. The inventor also found that a downward force was exerted by the stitch loop and the two blades of the tongues could be closed, making it hard for the receiving needle to be inserted into the tongues.

SUMMARY OF THE INVENTION

The task of the present invention is to improve the yarn feeding conditions for the compound needle and to prevent the tongues from being bent or being closed under a load onto the tongues at the time of transfer.

The present invention is a flat knitting machine wherein at least a pair of needle beds are arranged to oppose each other with a trick gap between them and each needle bed has compound needles, each comprising: a slider having two blades with tongues formed at a head thereof and a slider butt; and a needle body having a hook at a head thereof and a needle body butt, wherein said compound needles are arranged in such a way that said slider and said needle body are moved independently of each other forward and backward, wherein said needle body and said slider have inactive positions on the needle bed, wherein the slider is controlled with combination of said slider butt and a slider cam lock provided on a carriage reciprocating over said needle beds, wherein the needle body is controlled with combination of said needle body butt and a needle body cam lock, and wherein said slider cam lock and said needle body cam lock are arranged symmetrically about a center of each cam lock, said flat knitting machine characterized in that said slider cam lock guides the slider into a tuck route, a knit route branching from the tuck route toward the trick gap outside the center of the cam lock, and a transfer route branching from the knit route toward the trick gap at the center of the cam lock selectively, that a first movable cam is provided at the center of the slider cam lock for controlling the branch to the knit route and to the transfer route, that said needle body cam lock is provided with a raising cam located at the center back of the cam lock and making the needle body move toward the trick gap, a second movable cam located at the front center of the raising cam, a bridge cam located in the front of the raising cam and on both sides of the second movable cam and making the needle body retract from the trick gap, and a pair of stitch cams located on both outer sides of the bridge cam and making the needle body retract from the trick gap, that said needle body cam lock guides the needle body to the tuck route guiding the needle body, outside the center of the cam lock, to a tuck level being closer to the trick gap than the inactive position, and next guiding the needle body substantially linearly to the stitch cam, the knit route branching from the tuck route after the tuck level being reached, guiding the needle body to a knit level being closer to the trick gap than the tack level, retracting the needle body from the trick gap outside the center of the cam lock, and joining the tuck route, the transfer route branching near a joining point of the knit route and the tuck route, and retracting the needle body, having passed through the knit route, to a level between the inactive position and the tuck level, and a receiving route extending from the center of the raising cam toward the trick gap and joining the tuck route, that said second movable cam controls branching to the transfer route, and that is provided a means for controlling the branch from the tuck route to the knit route.

Preferably, a selection jack having a selection jack butt is provided at a back of the needle body butt of said needle body, and is provided a presser pressing the selection jack butt and sinking the needle body and the slider into the needle bed for undoing their engagements with said slider cam lock and said needle body cam lock, and said presser is provided with a first presser preventing the needle body from entering into the knit route and making the needle body run the tuck route, a second presser making the needle body having been retracted to the level between the inactive position and the tuck level, run at the same level, and a third presser guiding the needle body to the center of the raising cam.

Preferably, said first movable cam and said second movable cam are retractable.

Preferably, said raising cam is provided with a first guide face guiding the needle body to the tuck level, a second guide face guiding, in succession to the first guide face, the needle body to the tuck level, and a third guide face guiding the needle body in the receiving route, the first guide face and the third guide face are set at a same height higher than the second guide face, and a bottom of the receiving route facing the third guide face is set substantially at same height as the second guide face.

Preferably, said slider cam lock is provided with a bypass route branching from the knit route and guiding the slider, at a level of the knit route, into the trailing cam lock.

Basic knitting modes with compound needles are knit, tuck and transfer, and transfer has two actions; transferring and receiving. As a result, three routes, knit, tuck and transfer, are required for the slider, and the knit route is a little advanced than the tuck route to receive the old loop from the hook. The transfer route is most advanced to transfer the stitch loop onto the hook of the receiving needle. In the mode of receiving, the slider does not play any important role, and there is no need of considering a receiving route.

As for the needle body, to move the old loop from the hook onto the slider, the knit route needs to be advanced toward the trick gap more than the tuck route. To move the loop onto the slider, the transfer route needs to be advanced to the knit position, and after that, the transferring needle must be retracted to avoid interfering with the receiving needle. The receiving needle needs to be retracted while the loop is moved from the transferring needle onto the slider, and after that, the receiving needle needs to be advanced to the tuck position.

The slider cam lock and the needle body cam lock according to the present invention clearly meet the above-mentioned conditions. As for the control of the slider, branching from the knit route to the transfer route is effected at the center of the cam lock, and the movable cam that is required for this can be an in-out type cam of high reliability, and a single movable cam will do. Further, if a bypass route for the slider butt is provided, formation of new stitches such as split knitting, plating and pile knitting can be made. The trailing cam lock can be another cam lock or the same cam lock that is reversed.

With regard to the control of the needle body, the knit route branches, outside the center of the raising cam, from the tuck route, and returns, outside the center of the raising cam, to the tuck route. After that, up to the stitch cam, the tuck route and the knit route is the same route. After the arrival at the stitch cam, the yarn feeder is moved away or the yarn feeder is lowered toward the needle bed side to reduce the difference in elevation between the yarn feeder and the hook that catches the yarn at the stitch cam so that the hook can easily catch the yarn.

In the transfer mode, the needle body branches, at the second movable cam, from the knit route or the subsequent tuck route. This movable cam can be, for example, an in-out type cam that is simple in mechanism and has a high reliability. At the second movable cam, the needle body is retracted to a position between the tuck position and the inactive position, and the hook protrudes slightly into the trick gap to prevent the two slides constituting the slider from being bent. The hook also prevents the two blades from being closed under the load of the stitch loop, that will eliminate from the slider any gap into which the receiving needle enters.

Branching from the tuck route to the knit route may be controlled by the movable cam. However, if the presser is used to sink the needle into the needle groove to keep it away from any action of the cam lock, the cam lock can be reduced in size.

When the presser is used, required movable cams according to the present invention are, for example, of two kinds, the first movable cam and the second movable cam. Thus the number of movable cams can be reduced in comparison with the case in which all is effected by movable cams. This contributes to the reduction in size of the cam lock.

If the first guide face, that guides the needle body to the tuck level, and the third guide face, that guides the needle body in the receiving route, are set at the same height, and the second guide face, that succeeds the first guide face and guides the needle body to the knit level, is set lower than the first guide face, branching to the tuck route and to the knit route by the presser can be made easily. If the bottom of the receiving route facing the third guide face is set at a height substantially identical to that of the second guide face, the bottom of the transferring route, that is lower than the second guide face, will become lower than the bottom of the receiving route, and the receiving route and the transfer route can be distinguished clearly from each other. Moreover, the third guide face and the first guide face can be connected with each other smoothly, thus the needle body can be advanced to the tuck position smoothly along the receiving route.

BRIEF DESCRIPTION OF THE DRAWINGS

FIG. 4 is an enlarged view of a part of the compound needle of FIG. 3.

FIG. 6 shows blades of the slider that are advanced beyond the hook.

FIG. 6-*a* is an enlarged side view thereof.

FIG. 6-*b* is a plan view thereof.

EMBODIMENT

An embodiment of compound cam system of a flat knitting machine will be described with reference to the attached drawings.

Figure 1:
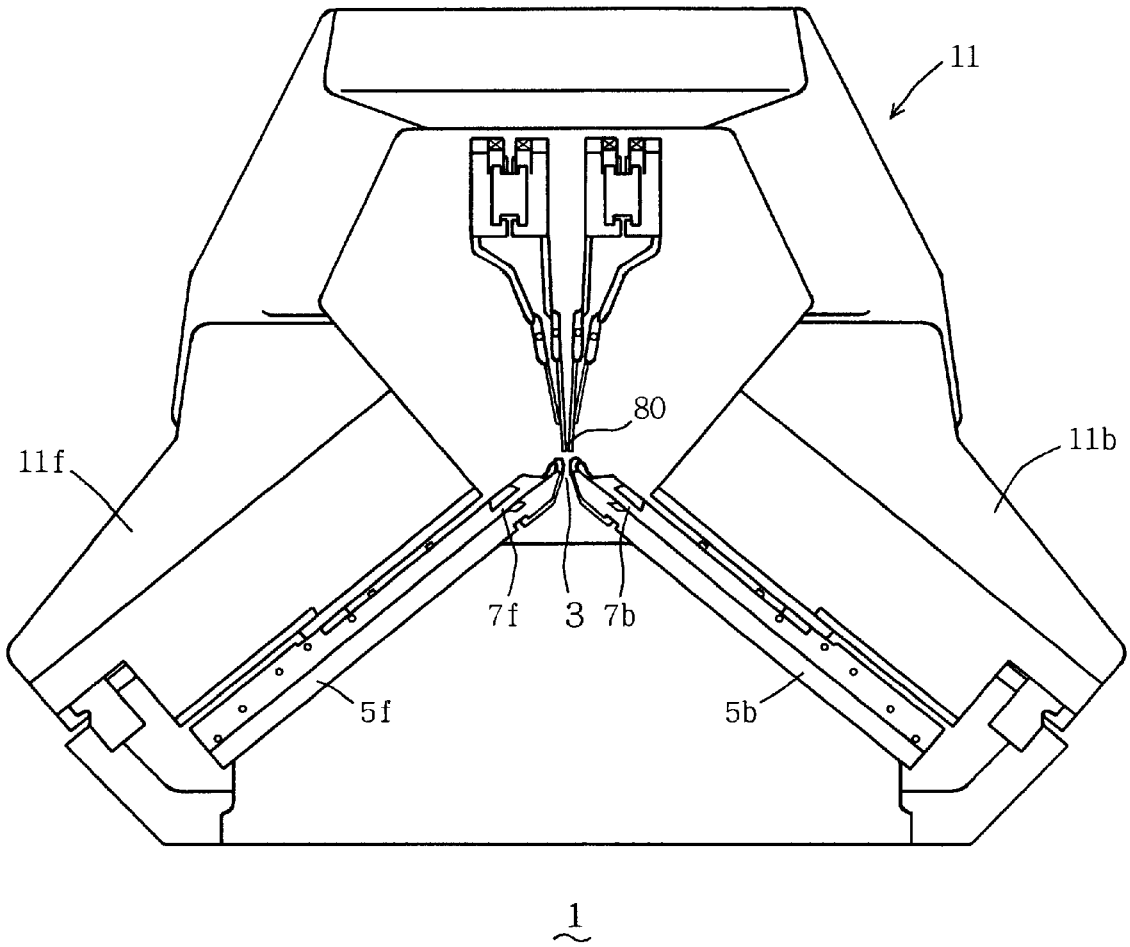
FIG. 1 is a side view of a flat knitting machine that is used in the embodiment.
Figure 2:
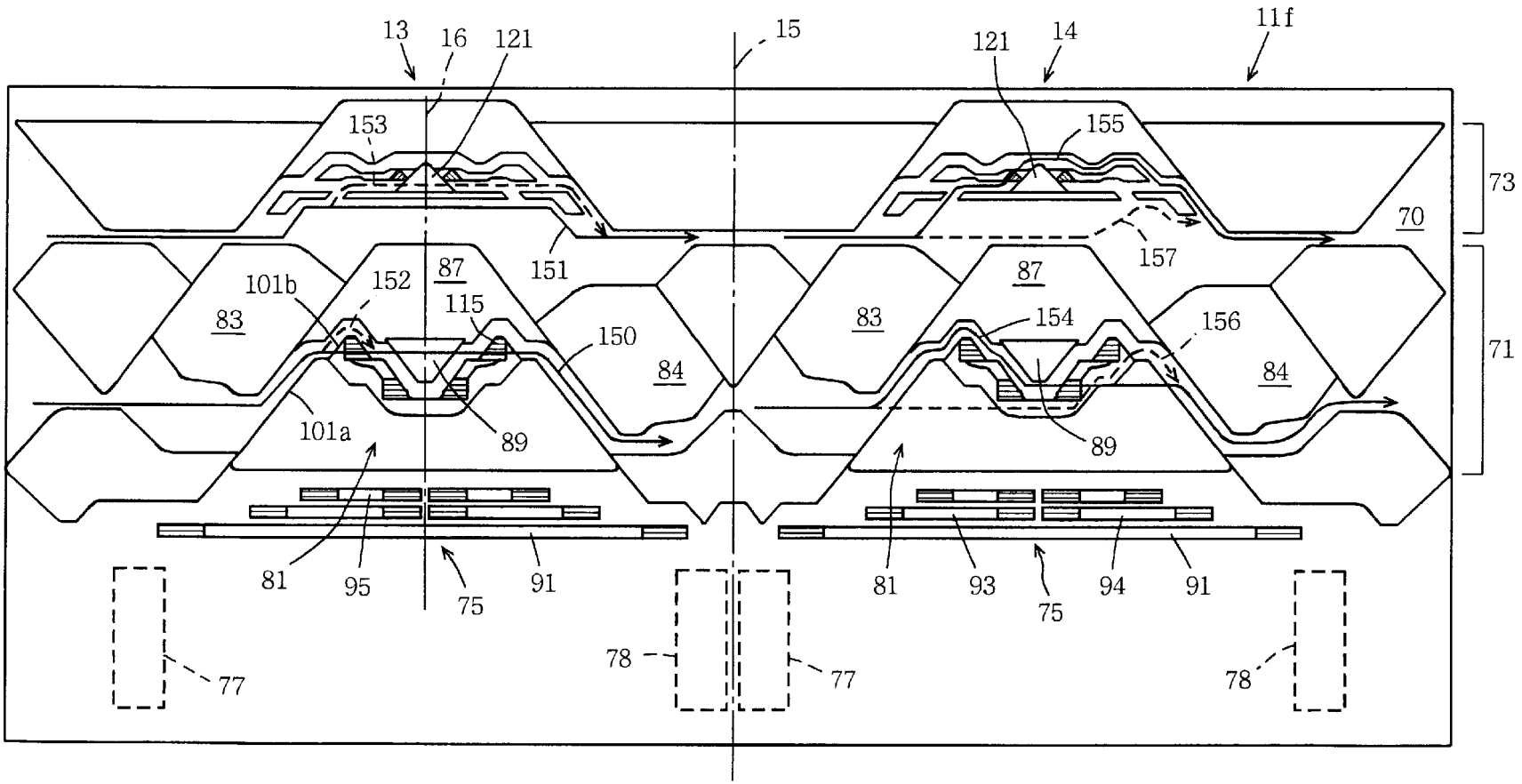
FIG. 2 is a perspective view of cam locks that are mounted on the carriage of the flat knitting machine.

FIG. 1 is a side view of a flat knitting machine. The flat knitting machine 1 has a front needle bed 5*f* and a back needle bed 5*b* that are opposed to each other with a trick gap 3 between them. On the respective needle beds 5*f*, 5*b*, are mounted a large number of compound needles 7*f*, 7*b*. 11 denotes a carriage that makes the needles of the needle beds move forward or backward, and the carriage 11 is made to reciprocate over the needle beds by a driving means that is not illustrated. The carriage 11 consists of a front carriage 11*f* and a back carriage 11*b*. The front carriage 11*f* and the back carriage 11*b* are arranged symmetrically about the trick gap 3. FIG. 2 is a cam layout diagram drawn in perspective, showing the cam lock mounted on the front carriage 11*f*. The carriage 11*f* is provided with two cam locks 13, 14, and each of these cam locks can effect stitch formation and transfer without being restrained by the direction of the carriage.

Figure 3:
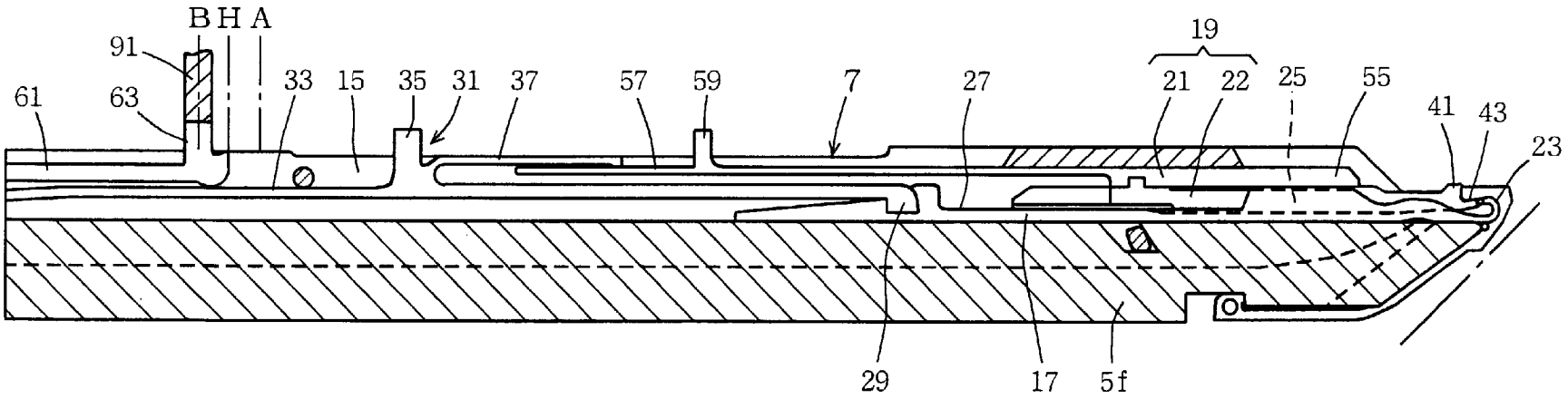
FIG. 3 is a side view of a compound needle that is mounted in a needle bed.
Figure 5:
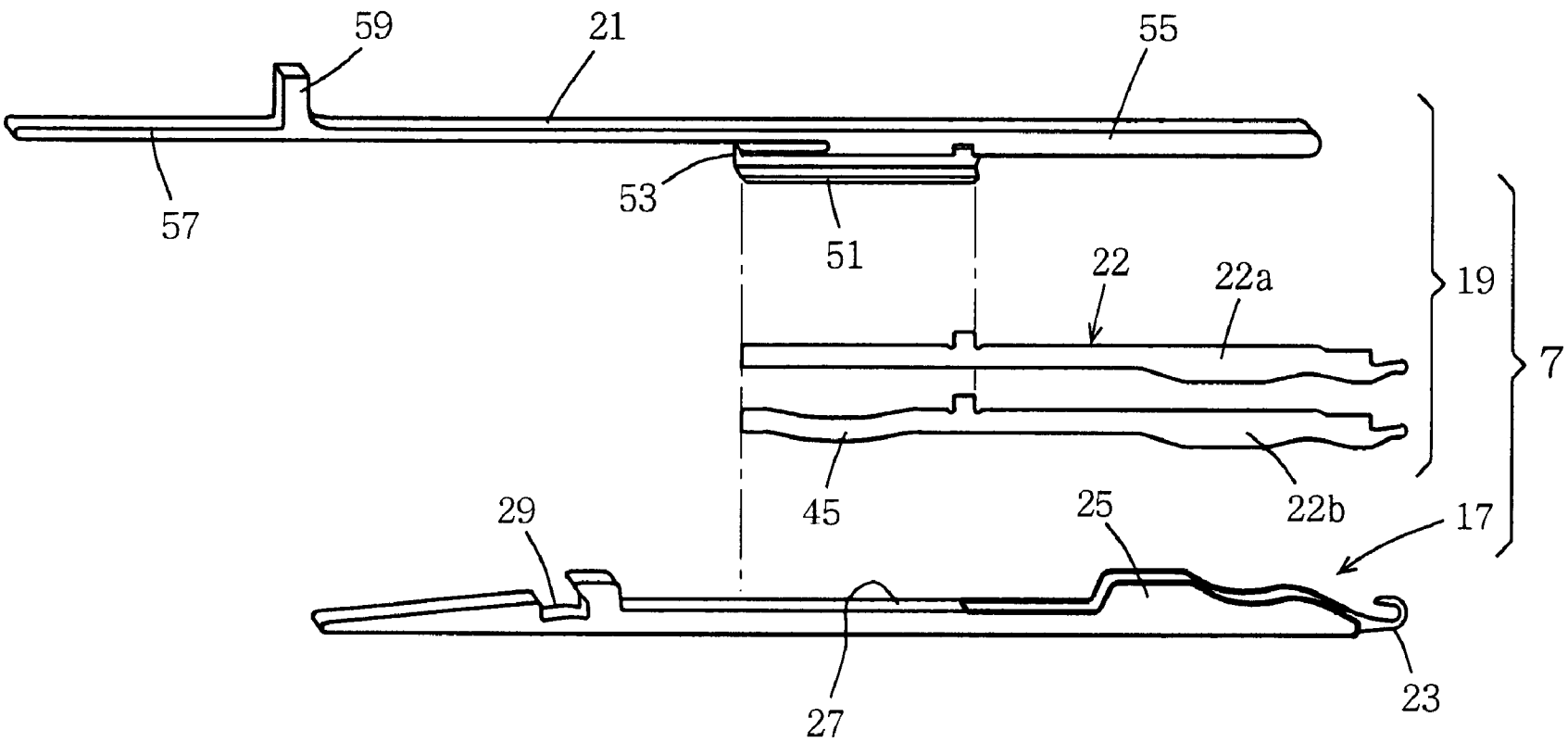
FIG. 5 shows respective parts that constitute the compound needle.

FIG. 3 through FIG. 5 shows the needle 7 that is mounted in the needle bed. FIG. 3 shows the needle 7 that is mounted in a needle groove that is formed in the needle bed 5*f*. FIG. 4 is an enlarged view of a part of the needle of FIG. 3, and FIG. 5 shows the respective parts that constitute the needle 7. The needle 7 is a compound needle that is composed of a needle body 17 and a slider 19. The slider 19 is composed of a slider proper 21, that has the same thickness as the needle body 17, and two thin blades 22*a*, 22*b*.

The needle body 17 is provided with, from the top end thereof, a hook 23, a blade holding groove 25 that contains blades 22, a central part 27 that receives the under arm 51 of the slider proper 21 and forms the sliding support surface for the under arm 51, and at the tail end of the needle body 17, a concave 29 into which the top end of the jack 31 is fitted.

The jack 31 extends from the concave 29 of the needle body 17 toward the back of the needle bed, and has a curved elastic leg 33 of which tail end contacts the bottom of the needle groove. With this arrangement, the jack butt 35 is energized to protrude from the surface of the needle bed. In front of the jack butt 35 is provided a branched arm 37 that branches from the jack proper and extends forward. The jack butt 35 is made to engage with the cam surfaces of the needle body cam lock 71, that is provided on the carriage and will be described later, to move the jack butt 35 forward or backward, and in turn, to move the needle body 17 forward or backward. The needle body 17 and the jack 31 are constituted as separate parts, but they may be constituted as an integral part. The needle body of the present embodiment has no butt, and its forward/backward movement control is given by the jack butt 35. Hence the jack butt is described as the butt of the needle body in the present specification. When the select jack butt 63 is pressed downward by a presser of the presser unit 75 into the needle groove, the butt 35 of the needle body will be moved into an inactive position in which it will not engage with any cams.

A step 41 and a tongue 43 are formed on each blade 22 at the top end thereof. The tail ends of the blades 22, that are exposed from the blade holding groove 25, are fixed into the slider proper 21. A bent 45 is formed in the rear end of the blade 22*b* being a thin plate. With this arrangement, when the slider 19 is mounted in the needle groove 15, the needle body 17 is pressed to contact the side wall of the needle groove; this prevents the slider 19 from being moved inadvertently when the needle body 17 is moved forward or backward.

The under arm 51, that extends to the central part 27 formed on the needle body 17, is formed on the slider proper 21 at the center thereof and a little to the front. One side of this under arm 51 is cut to form a longitudinal groove 53, and blades 22 are fitted into this groove 53. On the front side of the slider proper 21, is formed a front 55 that extends forward above and in parallel with the blades 22. This front 55 contacts the upper edge of the needle body to support the blades 22. The slider proper 21 has a rear part 57 that extends between the main part and the branched arm 37 of the jack 31. A slider butt 59 is formed protrusively on the upper edge of this rear part 57. When this slider butt 59 engages with a cam of the slider cam lock 73, that will be described later, and is subjected to forward/backward movement control, the slider 19 will be moved forward toward or backward from the trick gap.

The slider 19 and the needle body 17 are moved relative to each other by controlling the slider butt 59 and/or the jack butt 35. When the top ends of the tongues 43 are moved downward away from the hook 23, the hook is open. When the top ends of the tongues 43 contact the hook 23, the hook 23 is closed. When the tongues 43 are advanced beyond the hook 23, as shown in FIG. 6, two blades 22*a*, 22*b*, being thin plates, will be diverted by the hook 23 from each other and held by sides of the hook, spreading the top ends of the tongues 43*a*, 43*b*. 63 denotes the butt of the selection jack 63 that is provided above the jack. The butt 63 is selected to be one of positions A, H, B by the work of the selectors 77, 78.

As shown in FIG. 2, on the carriage 11*f*, two cam locks 13, 14 are arranged symmetrically about the center line 15. Here one of the cam locks, namely, the cam lock 13 will be described. The identical parts of the other cam lock 14 are denoted by identical numbers.

Figure 8:
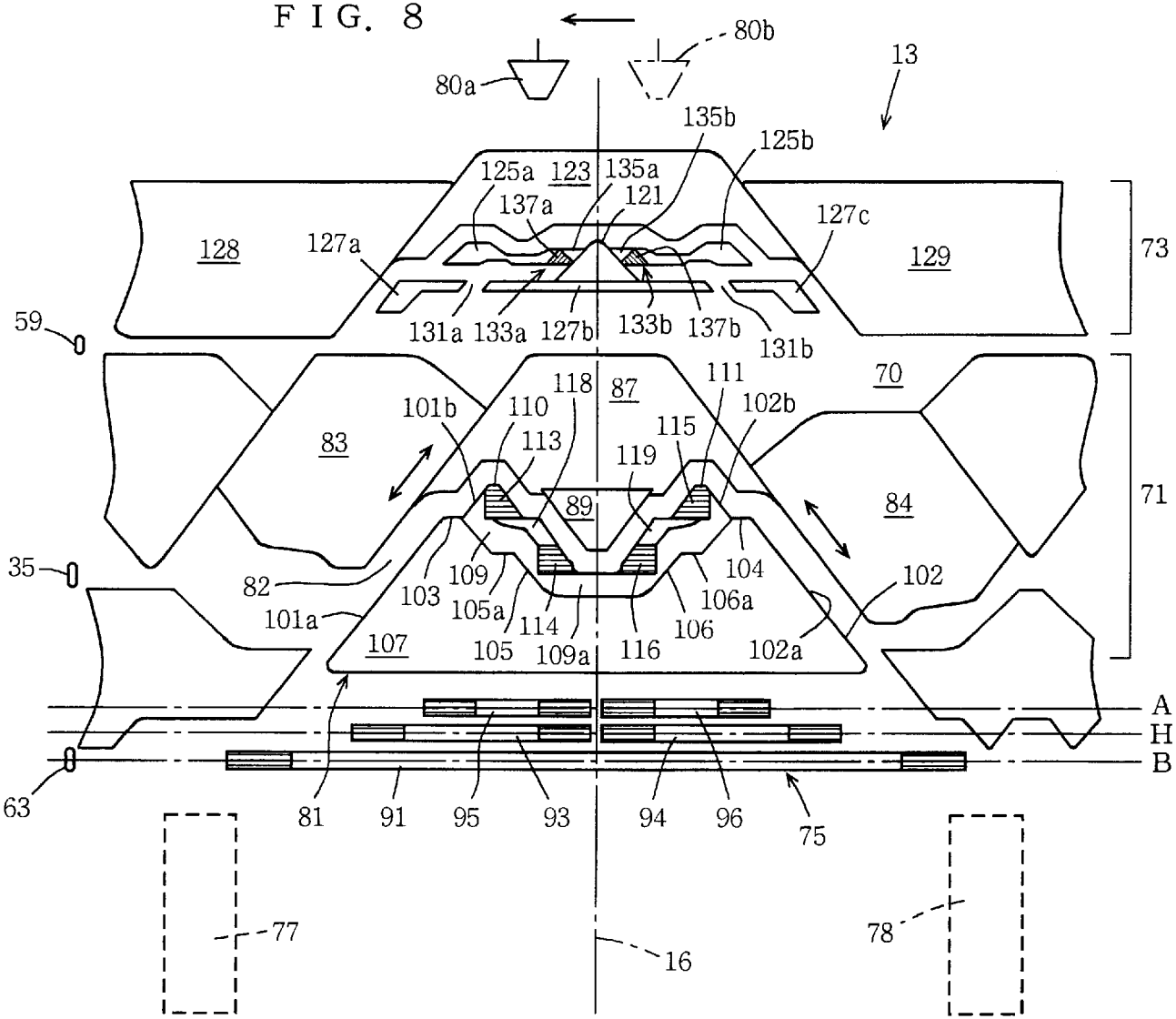
FIG. 8 is an enlarged view of one of the cam locks of FIG. 2.

As shown in FIG. 8, the cam lock 13 has a cam configuration that is symmetrical about the center line 16. The cam lock 13 is composed of a needle body cam lock 71, a slider cam lock 73, the presser unit 75, and needle selectors 77, 78. The jack butt 35 is engaged with the needle body cam lock 71 to move the needle body 17 forward/backward. The slider cam lock 73 is located in front of the needle body cam lock 71 and is closer to the trick gap. The slider cam lock 73 engages with the slider butt 59 to move the slider 19 forward/backward. The presser unit 75 is arranged at the back of the needle body cam lock 71, and the selectors 77, 78 are at the back of the presser unit 75, and are arranged on both sides of the cam lock. The needle is selected, via the selection jack 61, by the selector 77 or 78, and is carried to the cam lock. Then knit, tuck, miss or transfer is effected. Marks 80*a*, 80*b* denote yarn feeders. 80*a* indicates the position of the yarn feeder for the cam lock when the carriage direction is leftward. 80*b*, that is indicated by dashed line indicates the position of the yarn feeder for the cam lock when the carriage direction is rightward. Both yarn feeders 80*a*, 80*b* are located on the carriage direction side of the center line.

The cam lock 13 has a cam configuration that is symmetrical about the center line 16. The slider cam lock 73 is composed of fixed slider guide cams 123, 125*a*, 125*b*, 127*a*, 127*b*, 127*c*, and a first transfer control cam 121 that is arranged in the center and can be switched to be in or out. The slider guide cams 127*a*, 127*b* and 127*c*, that are arranged at the backmost, are composed of the guide cam 127*b* that is at the center, and guide cams 127*a*, 127*c* that are at the edges. In these cams are formed connecting paths 131 that guide the slider butt 59 to the slider butt groove that is formed between the guide cams 125*a*, 125*b* and the guide cams 127*a*, 127*b*, 127*c*. The base of the first transfer control cam 121, that is triangular, contacts the front edge of the slider guide cam 127*b*, and the vertex of the cam 121 faces the slider butt groove that is formed between the slider cam 123 and the slider cams 125*a*, 125*b*. Between the slider guide cams 125*a*, 125*b*, that are located in the middle, and the first transfer control cam 121, are formed connecting paths 133*a*, 133*b* that guide the slider butt to the slider butt groove that is in the foremost. The slider guide cams are all composed of cams of full height except the cams 135*a*, 135*b* that are of half height. 137*a* and 137*b*, that are illustrated by slant hatching, denote slopes that connect a half height portion and a zero height portion.

The needle body cam lock 71 is composed of a raising cam 81 having two humps, stitch cams 83, 84, a bridge cam 87 that is in front of the raising cam 81, and a second transfer control cam 89 that is located between the two humps of the raising cam 81. The stitch cams 83, 84 are located on both sides of the raising cam 81 with a butt path 82, that permits passage of the jack butt 35, in between. Of these cams, the raising cam 81 and the bridge cam 87 are formed as fixed cams. The stitch cams 83, 84 are made slidable in the directions of the arrows. The second transfer control cam 89 is constituted as a movable cam that can be switch to be in or out.

Figure 7:
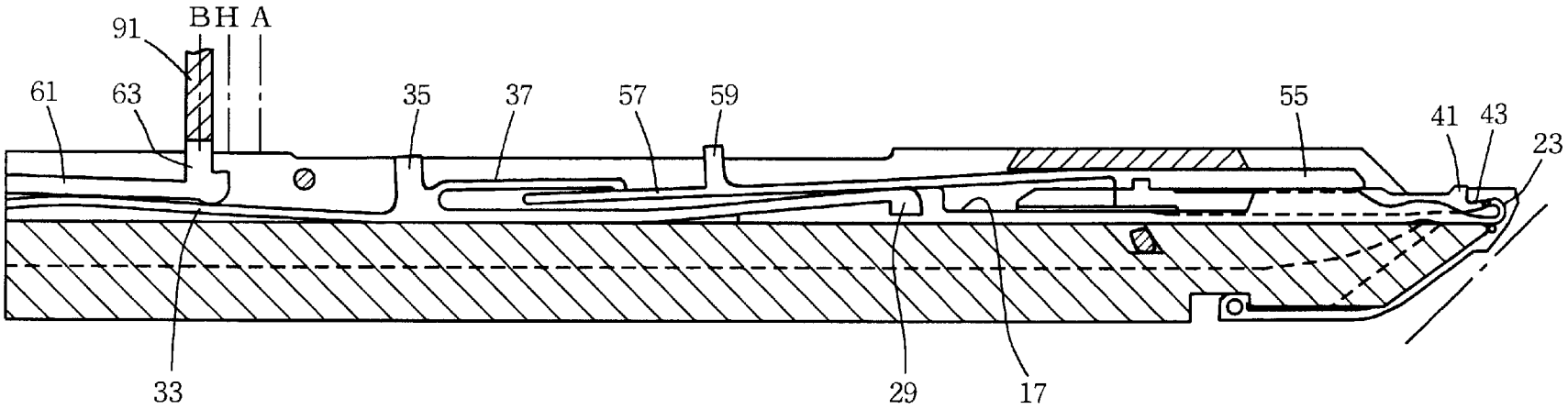
FIG. 7 shows the state when the jack butt is pressed by a presser.

The presser unit 75, that is at the back of the raising cam 81, are provided with presser cams in the respective positions A, H, B. In the position B is provided a B (inactive) presser 91 that is longer than the length of the base of the raising cam 81. In the position H are provided H pressers 93,94 that cover the left and right humps of the raising cam. In the position A are provided A pressers 95, 96 that cover the tops of the humps of the raising cam 81. Pressers except the B presser 91 are constituted as movable presser cams that can be switched to be in or out. FIG. 7 shows the state when the select jack butt 63 is pressed by the B presser 91.

When described in detail, the raising cam faces of the raising cam 81 are composed of the raising cam faces 101*a*, 102*a* that make the jack butt 35 advance to the positions of the shoulders 103, 104 (tuck level), and the raising cam faces 101*b*, 102*b* that make the jack butt 35 advance from the shoulder 103, 104 to the positions of the tops 110, 111 (knit and transfer levels). If the surface height of the cam plate 70 is expressed as zero height, the cam lock is composed of cams of full height, of which cam faces are closest to the needle bed, and cams of half height, of which cam faces are at a height that is intermediate between the zero height and the full height. A cam portion 109 of half height is formed on the periphery of the raising cam 81 between the shoulders 103, 104, as if it stands face to face with the bridge cam 87 and the second transfer control cam 89. The raising cam faces 105, 106 are formed at the boundary between the cam portion 109 of half height and the cam portion 107 of full height between the shoulders 103, 104 of the raising cam 81. Flat portions 105*a*, 106 are formed in the middle of the raising cam faces 105, 106. These raising cam faces 105, 106 engage with the jack butt 35 of the receiving needle at the time of transfer, that will be described later, to guide the needle to the receiving level. 113~116 that are illustrated by horizontal hatching denote slopes that connect the surface of the cam portion 109 of half height and the surface of the cam plate 70 of zero height. 118 and 119 denote cams of full height.

Let us go back to FIG. 2. 150 denotes the tuck route of the needle body, and 151 denotes the tuck route of the slider. 152 denotes the knit route of the needle body, and 153 denotes the knit route of the slider. 154 is the transfer route of the needle body, and 155 denotes the transfer route of the slider. 156 is the receiving route of the needle proper, and 157 is the receiving route of the slider.

The knit route branches from the tuck route on the front side of the raising cam 81, and joins the tuck route 150 short of the center line 16. During this time, the hook 23 advances to the knit position to move the old loop onto the tongues 43. The branching of knit/tuck is effected by the A presser 95. After the joining of the knit route 152, the tuck route 150 remain substantially at the same level till it reaches the stitch cam 84. And the yarn feeder can be located at any desired point in this range. Thus catching of the yarn can be made easier by reducing the inclination of the yarn from the yarn feeder. The slope 115 makes it easier for the tuck route to go over the raising cam face 101*b*.

As for the slider, the slider 19 follows the advancement of the needle body 17 to branch from the tuck route 151 to the knit route 153.

The routes of transfer and receiving will be described on the cam lock 14. On the transfer route 154 of the needle body, the loop is moved onto the tongues 43 at the knit position, and after that, the hook 23 is advanced a little beyond the inactive position on the needle bed by the second transfer control cam 89, then the hook 23 is retracted to the standby position in which the hook 23 protrudes slightly into the trick gap. The needle body 17 is sunk into the needle groove by the H presser 94 to cross the raising cam 81 to reach the position for contacting the stitch cam 84. As for the slider, branching from the knit route to the transfer route is effected by the first transfer control cam 121, and the slider holding the loop is advanced most for transfer. The needle of the receiving side is advanced by the H presser 93 to the center of the raising cam 81, then from there it is advanced to the tuck position to receive the loop from the slider of the transferring side. During this time, the hook of the transferring side is between two blades 22, 22 and takes a position advanced into the trick gap to prevent the blades from being bent by the force at the time of racking, and to prevent the blades from being closed by the force that is exerted by the fabric. The slider of the receiving side is advanced with the advancement of the needle body 17 to the tuck position, and after that, the slider is retracted.

Miss is another action of the flat knitting machine. This is effected by the presser 91, and the cam locks 13, 14 are not involved. The movable cams are of two kinds, and pressers of three kinds are used as well. As the movable cams are few, the cam locks 13, 14 can be compact, and the reliability is high.

Figure 9:
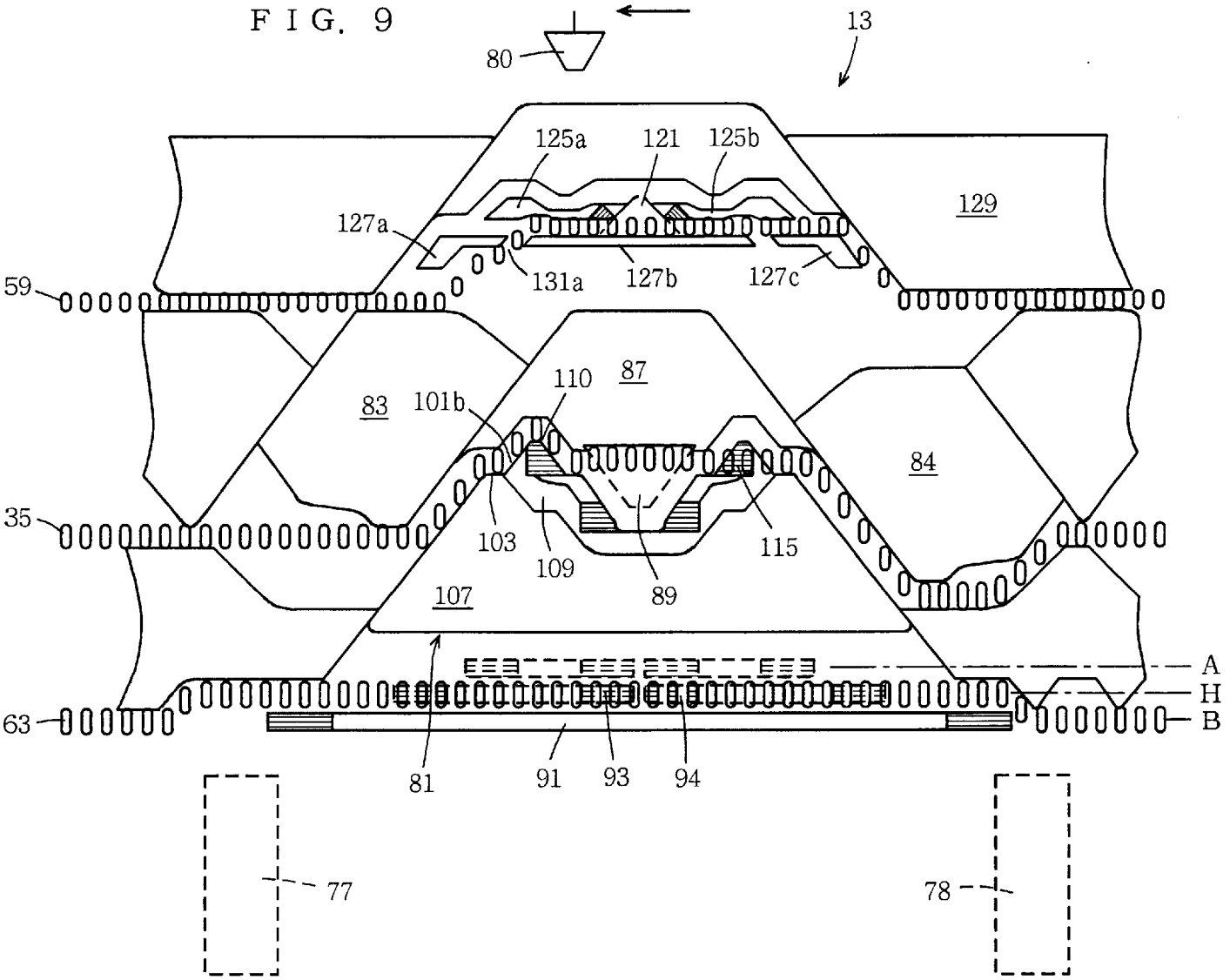
FIG. 9 shows the action of the cam lock in knit mode and the travel routes of the respective butts.
Figure 10:
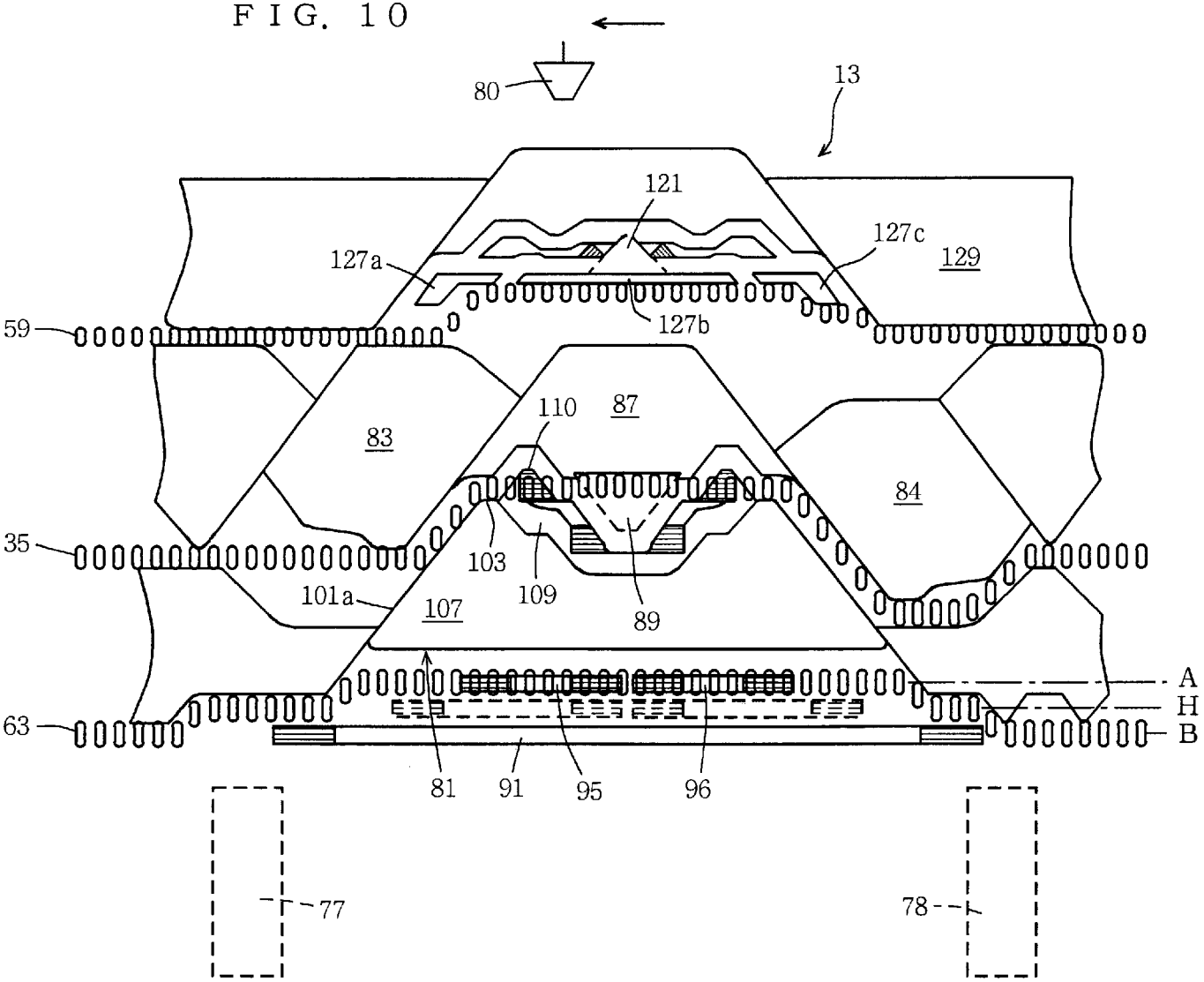
FIG. 10 is a diagram that corresponds to FIG. 9 in tuck mode.
Figure 11:
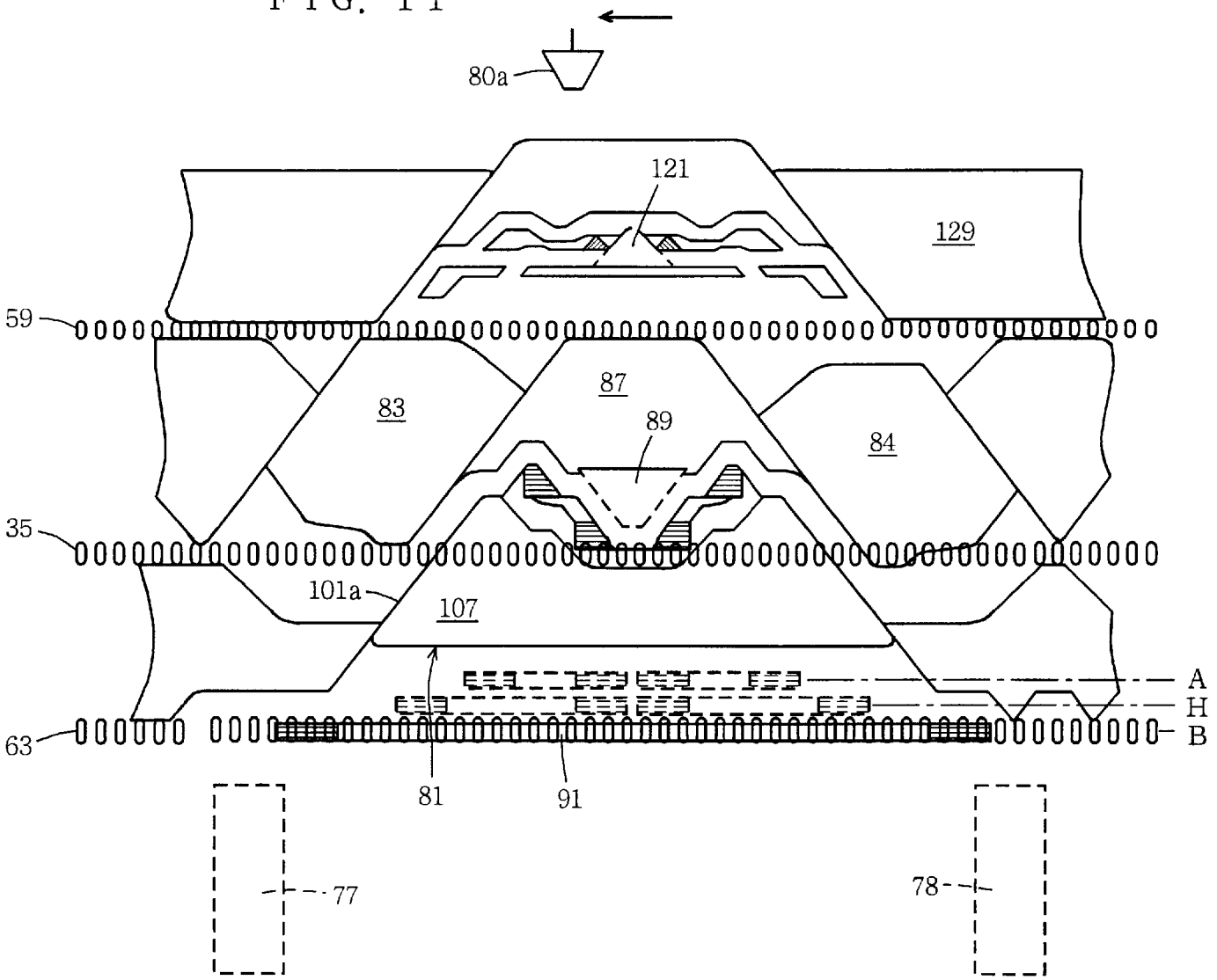
FIG. 11 is a diagram that corresponds to FIG. 9 in miss action.
Figure 12:
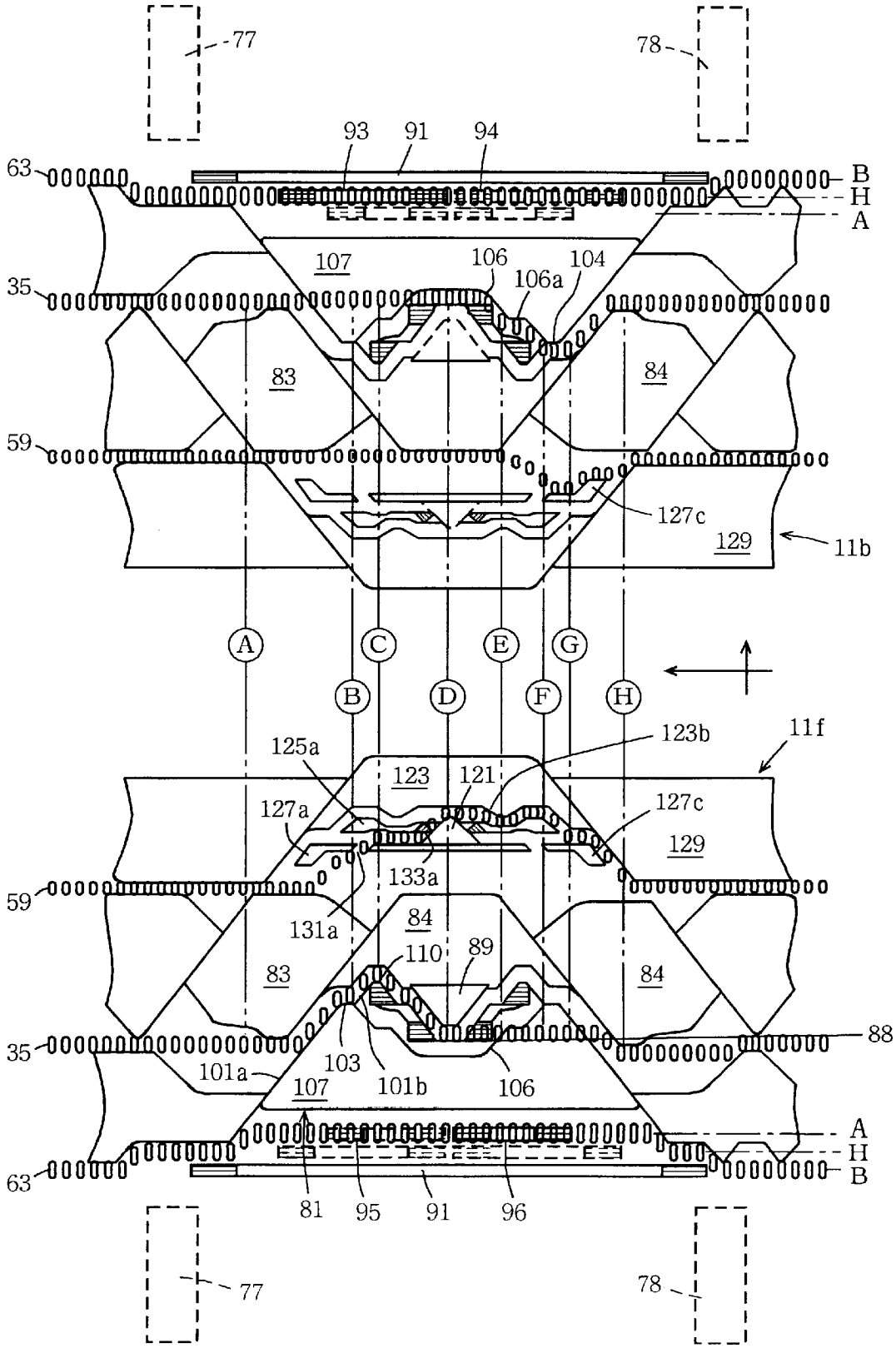
FIG. 12 is a diagram that shows cam locks and the travel routes of the respective butts when stitch loops are transferred from needles of the front needle bed to needles of the back needle bed while the carriage travels to the left.

Next, the knitting actions of the cam locks will be described. FIG. 9 through FIG. 11 show the actions of the cam locks and travel routes of the respective butts 35, 59, 63 in stitch loop formation (knit and tuck). FIG. 12 shows those at the time of transfer. FIG. 13 through FIG. 20 are sectional views of a part of the front and back needle beds, illustrating the forward/backward movements of the needles in the respective phases shown in FIG. 12. These diagrams show the states when the carriage travels to the left.

FIG. 9 shows knit formation. In this case, the transfer control cams 89, 121 and the pressers 93~96 in the positions A, H are sunk and set in the inactive positions. Under this condition, the selection jack butt 63 of the needle for knit formation is made to advance to the position H by the selector 77.

Figure 14:
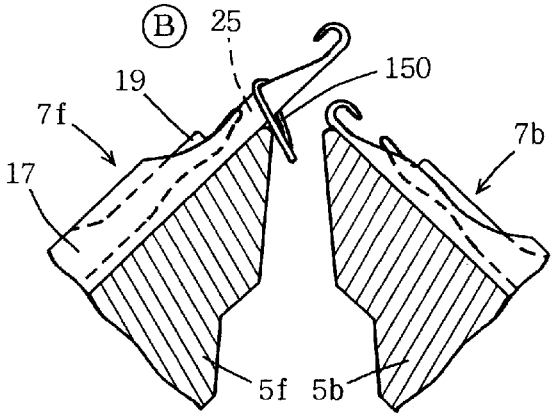
FIG. 14 is a sectional view of a part of the front and back needle beds in phase B of FIG. 12.

First, the jack butt 35 advances along the left raising cam face 101*a* of the raising cam 81. With this, the needle body 17 advances to cause a movement relative to the slider 19 and open the hook. When the jack butt 35 advances further along the left raising cam face 101*a* to reach the shoulder 103, the needle body 17 and the slider 19 will advance towards the trick gap. When the jack butt 35 is at the shoulder 103, the slider butt 59 is in contact with the back edge of the slider guide cam 127*a*, and the tongues 43 of the slider are stored in the blade holding groove 25 that is formed in the needle body 17, and the stitch loop held on the needle body 17 is positioned in front of the tongues 43 (FIG. 14).

Figure 15:
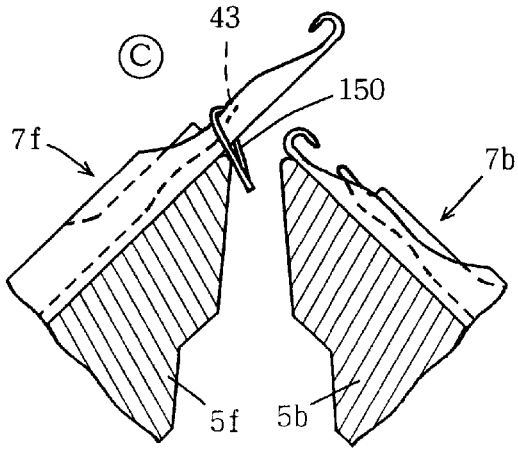
FIG. 15 is a sectional view of a part of the front and back needle beds in phase C of FIG. 12.

After that, the jack butt 35 advances along the raising cam face 101*b* to the top 110 of the raising cam 81, and during this time, the slider butt 59 advances, via the connecting path 131, to a position in which the slider butt 59 contacts the slider guide cam 125*a* in the middle. When the slider butt 59 is in this position, the tongues 43 of the slider penetrate into the stitch loop being held on the needle body 17 (FIG. 15).

The jack butt 35 passes the top 110 of the raising cam, then is guided by the down slope of the bridge cam 87 and is retracted to the position of the shoulder 103. From this shoulder 103, the jack butt 35 moves linearly, then it is guided by the subsequent slope 115 to pass by the hump and reach a point just short of the stitch cam 84. When the jack butt 35 engages with the down face of the stitch cam 84 and is retracted, the needle body 17 will catch the yarn (not illustrated) from the yarn feeder 80 by the hook, next, the hook will be closed by the movement relative to the slider, and the needle body 17 will be retracted to form a knit loop.

In the present embodiment, the yarn feeder 80 is ahead of the center of the cam lock 13. The yarn is extended from here to the needle that is just descending under the influence of the stitch cam 84. In this way, when the yarn feeder 80 is arranged to be ahead of the center of the cam lock, the distance between the yarn feeder 80 and the needle can be maximized without increasing the cam width of the raising cam. This is effective, not only in maintaining a good condition for yarn catching, but also in reducing the size of the carriage. This yarn feeding condition also applies to tuck formation that will be described later.

FIG. 10 corresponds to FIG. 9 in tuck formation. The second and first transfer control cams 89, 121 are set in inactive positions and the A pressers 95, 96 are set in the butt pressing position. The selection jack butt 63 of the needle on which the tuck loop is to be formed is advanced to the A position by the selector 77.

The jack butt 35 rises along the left raising cam 101*a* of the raising cam 81 to the shoulder 103, and with this, the slider butt 59 is advanced to a position in which the slider butt 59 contacts the back edge of the slider guide cam 127*a*. Beyond the shoulder, the jack butt 35 is sunk into the needle bed under the influences of the A pressers 95, 96, and will not be guided to the raising cam top 110. Hence the jack butt 35 will maintain the level of the shoulder 103 and reach a point just short of the stitch cam 84. During this time, the slider butt 59 also holds this level. After passing by the A presser 96, the jack butt 35 will come out of the needle bed short of the stitch cam 84, and retract along the down face of the stitch cam 84. At the same time, the slider butt 59 retracts along the down slope of the slider guide cam 127*c*. The yarn from the yarn feeder 80 is caught by the hook, next the hook is closed by the movement relative to the slider. Then the hook is retracted to form the tuck loop.

FIG. 11 is a diagram corresponding to FIG. 9 in miss action. In this case, the needle to make miss action is not selected. The selection jack butt 63 maintains the B position, and under the influence of the B presser 91, it is sunk into the needle bed. As a result, the jack butt 35 is also sunk into the needle bed, and the jack butt 35 moves straight without being influenced by any of cams in the cam lock.

Next, transfer will be described with reference to FIG. 12 through FIG. 20. FIG. 12 shows the cam lock and the travel routes of the respective butts when the stitch loop is transferred from the front needle 7*f* onto the back needle 7*b* while the carriage travels to the left. FIG. 13 through FIG. 20 are sectional views illustrating the movements of the needles in the respective phases A through H of FIG. 12. In the case of transfer, in the carriage 11*f*, that is on the stitch loop transferring side, the second and first transfer control cams 89, 121 and the A presser 96 of the trailing side are set in the active positions. On the other hand, in the carriage 11*b*, that is on the stitch loop receiving side, only the H presser of the leading side is set in the active position. The selection jack butt 63 of the front needle 7*f* that is to transfer the stitch loop is selected to be in the A position, and the selection jack butt 63 of the back needle 7*b* that is to receive the stitch loop is selected to be in the H position, respectively.

Figure 13:
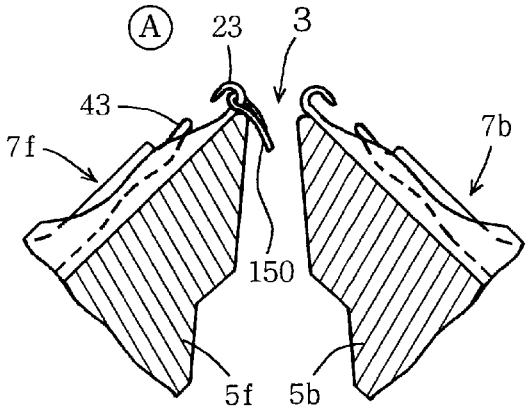
FIG. 13 is a sectional view of a part of the front and back needle beds in phase A of FIG. 12.

FIG. 13 is a sectional view at the position A, showing the front needle 7*f* that holds the stitch loop 150 on its hook 23, and the back needle 7*b* holding no stitch loop. At this position, all needles are in the inactive positions.

FIG. 14 shows the position B. The jack butt 35 of the front needle 7*f* advances along the raising cam face 101*a* of the raising cam 81 to the level of the shoulder 103. At the time, as a result of the relative movement of the needle body 17 and the slider 19, the tongues 43 of the slider are sunk into the blade holding groove 25, and the hook is completely open. The back needle 7*f* keeps its inactive position.

FIG. 15 shows the position C. The jack butt 35 of the front needle 7*f* advances along the raising cam face 101*b* to the raising cam top 110, and the slider butt 59 passes the connecting path 131*a* and advances to the position corresponding to the knit level. With this, the tongues 43 of the slider being held in the blade holding grooves 25 will penetrate the stitch loop 150 being held on the needle body 17.

Figure 16:
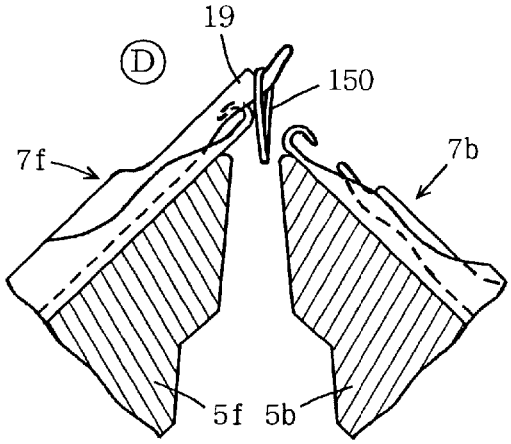
FIG. 16 is a sectional view of a part of the front and back needle beds in phase D of FIG. 12.

FIG. 16 shows the position of D. The jack butt 35 of the front needle 7*f* is guided by the bridge cam 87 and the second transfer control cam 89 and retracted to the standby position 88 to stand by. On the other hand, the slider butt 59 engages with the first transfer control cam 121 and rises to the transfer level. The standby position 88 of the needle body 17 is ahead of the inactive position, and it is such a position above the trick gap that when the receiving needle of the opposing needle bed is advanced, the needle body 17 is not interfered with by the receiving needle. This is, for example, between the tuck level and the inactive position. The selection jack butt 63 is sunk into the needle bed by the A presser 96. As a result, the jack butt 35 passes without engaging with the raising cam face 106 of the subsequent raising cam 81. Even when the selection jack butt 63 is pressed by the presser 96, the slider butt 59 is partly protruding from the needle bed. Hence the slider butt 59 is guided in the cam groove that is formed between the slider guide cams 123 and 125*b*.

Figure 17:
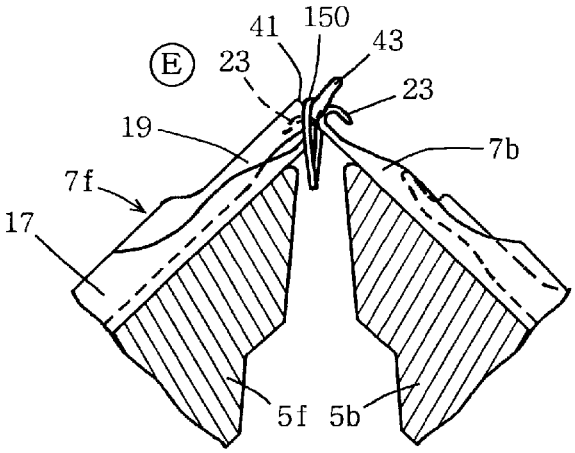
FIG. 17 is a sectional view of a part of the front and back needle beds in phase E of FIG. 12.

FIG. 17 shows the position of E. The needle body 17 of the front needle 7*f* keeps the condition of D, and the slider 19 is retracted a little by the guide cam 123*b* to loosen the stitch loop 150. The jack butt 35 of the back needle 7*b*, that has been kept in the inactive position, advances to the flat part 106*a* of the slope 106 of the raising cam 81 and keeps the position.

In the standby position 88, the hook 23 of the needle body 17 of the front needle bed is positioned near the step 41 and the roots of the tongues 43 of the slider 19 holding the stitch loop 150. By this, the blades 22 can be prevented from being bent when a lateral load is exerted by the stitch loop 150 at the time of racking. Moreover, by keeping the needle body 17 in this guide position, even shorter tongues can cover the area of the forward/backward movement route of the receiving needle.

Figure 18:
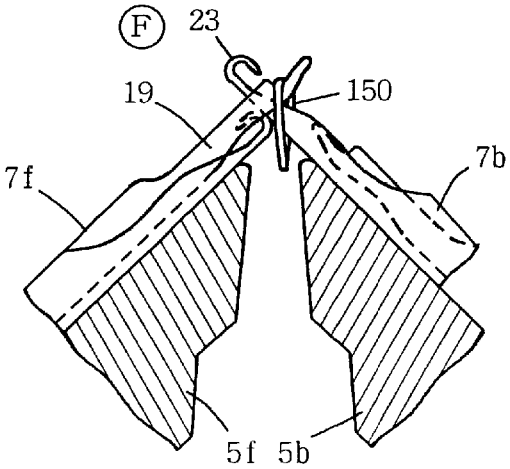
FIG. 18 is a sectional view of a part of the front and back needle beds in phase F of FIG. 12.

FIG. 18 shows the position of F. The slider 19 of the front needle 7*f* advances from the position of E to the transfer level. In succession to it, the jack butt 35 of the back needle 7*b* advances from the flat part 106 to the level of the shoulder 104. With this, the slider butt 59 advances to a position in which it contacts the back edge of the slider guide cam 127*c*. As a result, the stitch loop 150 is lifted, by the slider 19, to a position in which the stitch loop 150 faces the needle hook of the receiving needle. As a result, the hook 23 of the receiving needle is allowed to penetrate into the stitch loop 150.

Figure 19:
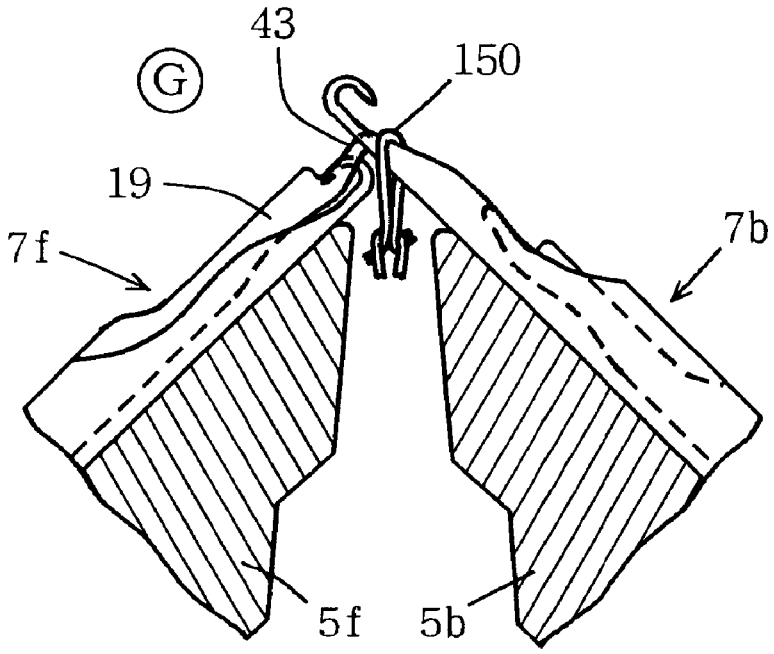
FIG. 19 is a sectional view of a part of the front and back needle beds in phase G of FIG. 12.

FIG. 19 shows the position of G, and the slider butt 59 of the front needle 7*f* retracts along the slope of the guide cam 123 to retract the slider 19. During this time, the receiving needle 7*b* of the back needle bed 5*b* keeps the position of F, and receives the stitch loop 150 that was held on the tongues 43 of the slider 19 of the front needle 7*f*.

Figure 20:
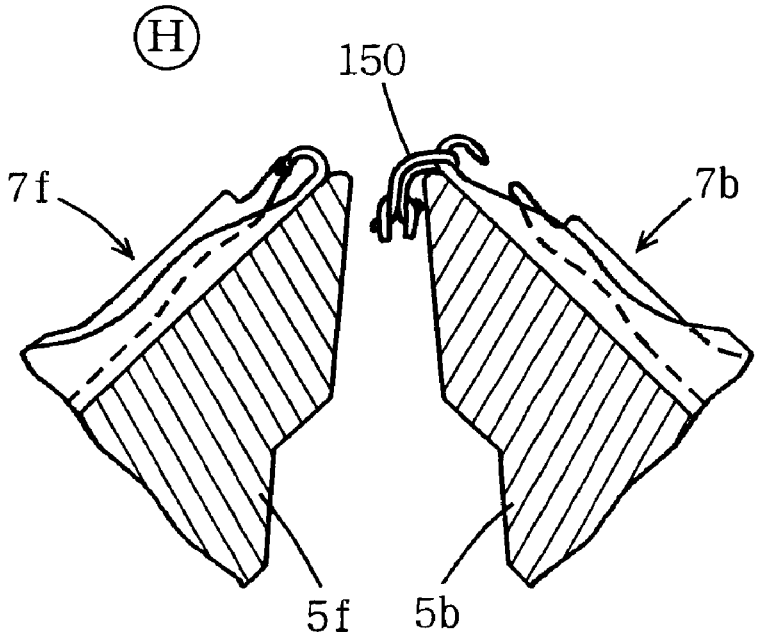
FIG. 20 is a sectional view of a part of the front and back needle beds in phase H of FIG. 12.

FIG. 20 shows the position of H. The jack butt 35 and the slider butt 59 of the front needle 7*f*, that kept the guide position 88, are retracted by the stitch cam 84 and the slider guide cam 129, respectively, to the inactive positions that are away from the trick gap. Similarly, the receiving needle 7*b* of the back needle bed 5*b* is retracted; the jack butt 35 is retracted by the stitch cam 84, and the slider butt 59 is retracted by the slider guide cams 127, 129 to the inactive positions, and the transfer is completed.

Modification

Figure 21:
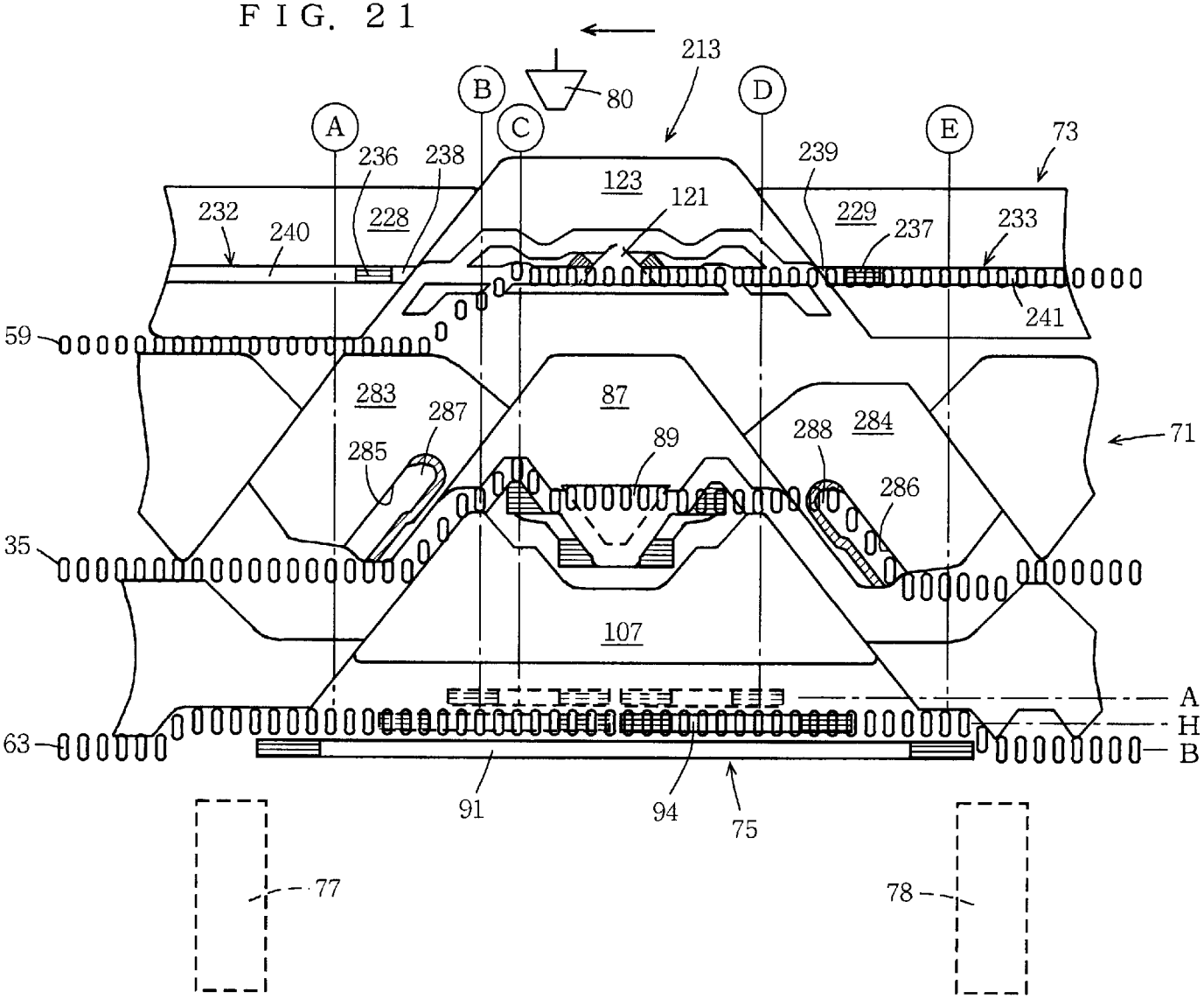
FIG. 21 shows a modification of the cam lock, illustrating the cam lock at the time of split knit and the travel routes of the respective butts.
Figure 22:
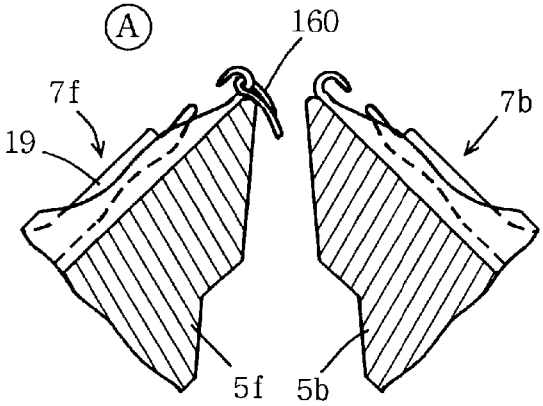
FIG. 22 is a sectional view of a part of the front and back needle beds in phase A of FIG. 21.
Figure 23:
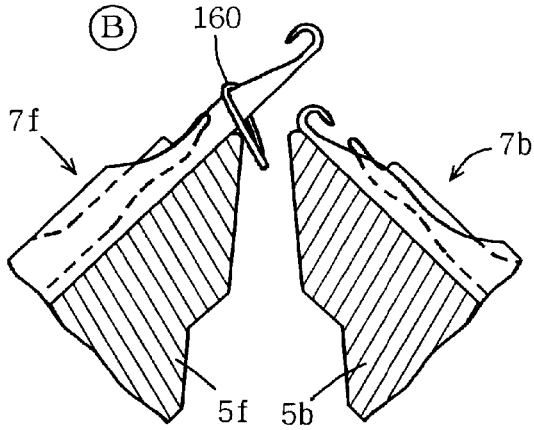
FIG. 23 is a sectional view of a part of the front and back needle beds in phase B of FIG. 21.
Figure 24:
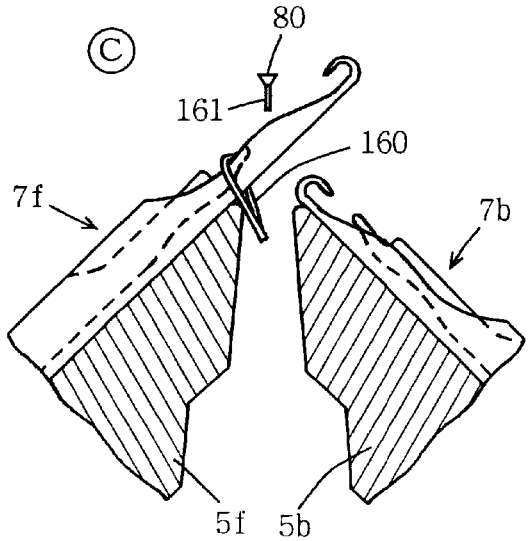
FIG. 24 is a sectional view of a part of the front and back needle beds in phase C of FIG. 21.
Figure 25:
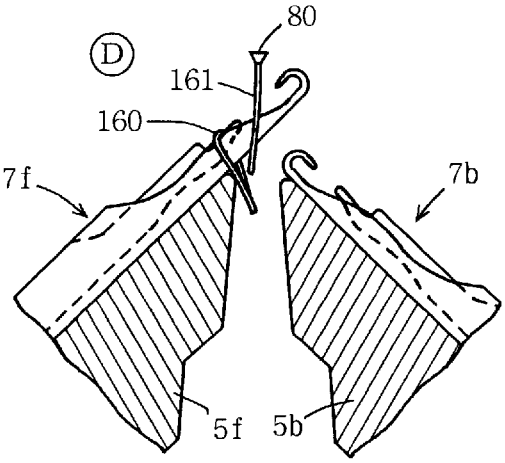
FIG. 25 is a sectional view of a part of the front and back needle beds in phase D of FIG. 21.

A modification of the cam lock 13 of the carriage 11*f* shown in FIG. 2 is shown in FIG. 21. New marks are given only to additions and modifications made by the modification, and other parts are denoted by identical marks. In the needle body cam lock 71, concaves 287, 288 are provided inside the stitch cams 283, 284, and the second down slopes 285, 286, that are parallel to the down slopes of the stitch cams, are formed in the concaves 287, 288. Bypasses 232, 233, that permit to keep the slider butt 59 in the advanced position and guide it to the subsequent cam lock, are provided in the guide cams 228, 229 that are adjacent to the slider guide cam 123 that is arranged in the center of the slider cam lock 73. The subsequent cam lock means, for example, the trailing cam lock 14 when the carriage moves to the left, and the same cam lock 13 in the next course (leftward) after reversal of the carriage when the carriage moves to the right. Marks 238, 239 denote cam grooves of half height that are provided at the ends of the bypasses. Marks 236, 237 denote slopes that connect cams 238, 239 and cam grooves 240, 241 of zero height.

As an example of stitch loop formation by the cam lock, a case will be described in which a stitch loop that is held on the hook of a front needle 7*f* is to be split-knitted (transfer-knitted) onto the opposing back needle 7*b*.

FIG. 21 shows the state of the cam lock 213 and the travel routes of the respective butts 35, 59, 63 when the carriage is going left, the cam lock 213 is the leading cam lock, the yarn 161 is fed by the yarn feeder 80 to form a knit loop that follows the stitch loop 160 of the preceding course. In this case, the second and first transfer control cams 89, 121 are set in the inactive positions, and in the presser unit 75 the H presser 94 of the trailing side is set in the active position. Under this condition, the selection jack butt 63 of the front needle 7*f* that makes split knit is advanced to the H position by the selector 77. As a result, the jack butt 35 and the slider butt 59 pass the same route as the knit formation till they reach the A presser 94 of the trailing side.

Sections of the needle beds in the respective phases A~D are shown in FIG. 22 through FIG. 25. When the selection jack butt 63 passes the H presser 94, the butt 63 will be sunk into the needle bed by the H presser 94, and the jack butt 35 will be sunk into the needle bed as well. As a result, the jack butt 35 does not engage with the first down slope of the stitch cam and moves straight to reach the concave 288. Then it is retracted by the second down slope 286. At this time, the slider butt 59 does not engage with the down face of the guide cam 229, gets over the cam 239 of half height that is formed at the edge of the bypass 233, and the slider butt 59 is guided into the bypass 233.

Figure 26:
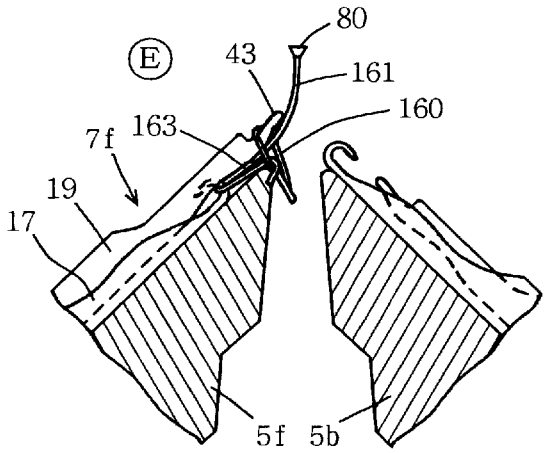
FIG. 26 is a sectional view of a part of the front and back needle beds in phase B of FIG. 21.

FIG. 26 shows the section of the needle beds in the phase E of FIG. 21. The needle body 17 catches the yarn 161, and is retracted by the second down slope 286 of the stitch cam to form a new stitch loop 163. The slider 19 is guided by the bypass 233 and keeps the knit level. As can be seen from the diagram, the state of the front needle 7*f* is such that the needle body 17 holds the present stitch loop 163 and the tongues 43 of the slider 19 hold the old loop 160. The front needle 7*f* under this condition is guided to the subsequent cam lock 14.

Figure 27:
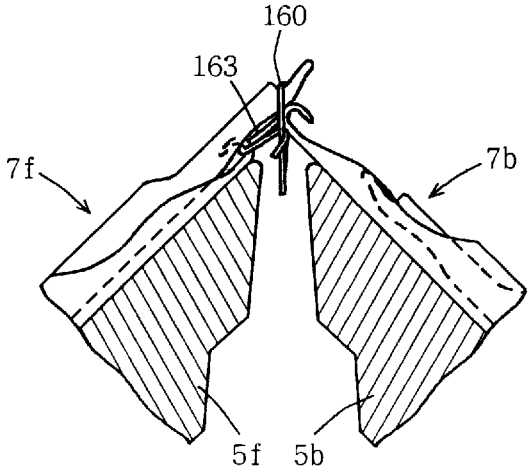
FIG. 27 shows the front and back needle beds when the slider is advanced by the trailing cam lock to the split knit level and the hook of the receiving needle enters into the blades.
Figure 28:
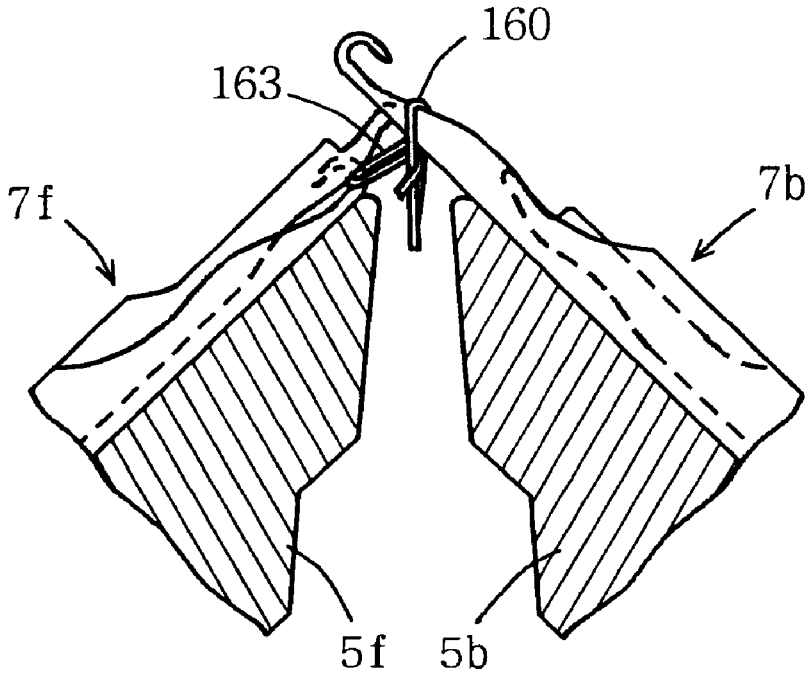
FIG. 28 shows the front and back needle beds when the stitch loop is transferred from the slider of the needle of the transferring side onto the needle body of the receiving side.
Figure 29:
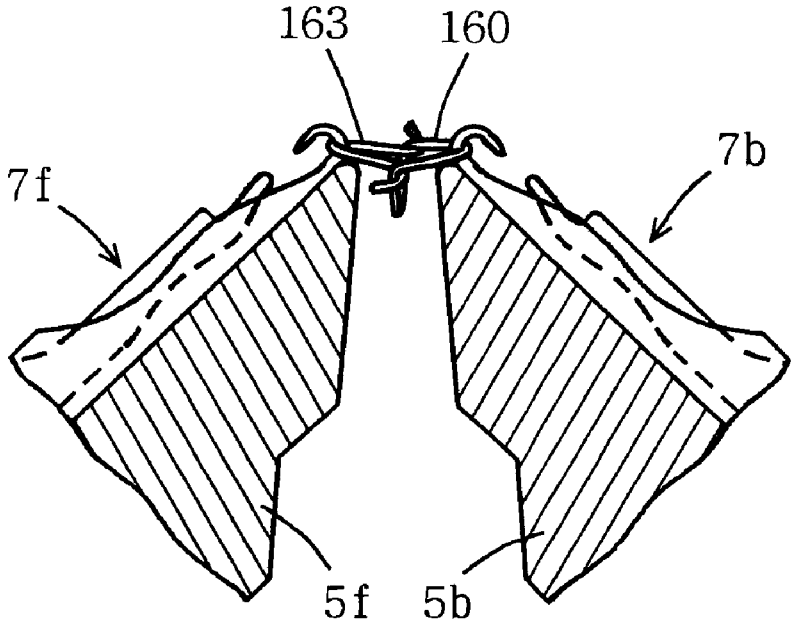
FIG. 29 shows the front and back needle beds when split knit is completed.

In the trailing cam lock (not illustrated), the cam lock is controlled so that the stitch loop 160 being held on the tongues 43 of the slider 19 are transferred onto the opposing back needle 7*b*. In the trailing cam lock 14 of the front carriage 11*f*, the needle body 17 is not operated, and to advance the slider 19 to the transfer level, the first transfer control cam 121 is set in the active position. In the back carriage 11*b*, to make the corresponding needle receive the stitch loop 160, the selection jack is selected to be in the H position, and the leading H presser 93 is activated to receive the stitch loop 160. The forward/backward movement control of the needles in this trailing cam lock 14 is shown in FIG. 27 through FIG. 29. At the time of completion of split knit, the new and old stitch loops 160, 163 are held on the front and back needles 7*f*, 7*b*, and the course is broadened.

With regard to operation of a compound needle, that is composed of a slider, that includes two blades having a tongue at the head thereof, and a needle body, if bypasses are made in the slider cam lock to keep the slider in the advanced position, the present stitch loop and the old stitch loop can be held on the needle body and the slider; thus split knit can be made.

To prevent a stitch loop from moving beyond the slider and being knocked over, the slider is kept protruded into the trick gap, then the stitch is guided to the subsequent cam lock. In this subsequent cam lock, required knitting operation is given. If this idea is applied, new stitch formation can be achieved, such as plating and pile knitting. For example, in plating, stitch loops of front yarn are formed by the leading cam lock, and stitch loops of back yarn are formed by the trailing cam lock, both stitch loops of front yarn and back yarn are held on sliders while the next courses of the stitch loops of front yarn and back yarn are formed, then when both stitch loops of the next course are formed, both stitch loops of front yarn and back yarn of the preceding course are knocked over from the sliders. These applications are described in a patent application made by the present applicant submitted to the U.S. Patent and Trademark Office on Jul. 13, 1998 Ser. No. 09/114,488. With regard to this application, the inventor is the same as the present application, and the title of the invention is a Stitch Forming Method and a Flat Knitting Machine therefor," and the priority of the Japanese Patent Application HEI 9-202462 is claimed in the European application and the U.S. application. Disclosures in these patent applications are regarded as a part of the disclosure in the present application.

Preferred embodiments of the compound cam system of the present invention were described above, however, the compound cam system of the present invention is not limited to them, and can be implemented in many ways as far as the gist of the present invention is not deviated. For example, in the embodiment, the yarn feeder is provided in a position that is ahead of the center of the cam lock. The essential thing is that when the yarn feeder is located in such a way that the yarn feeder trails the leading hump of the two-hump raising cam and the yarn feeder is ahead of the center of the cam lock, the yarn feeding condition can be improved relative to the conventional cam system. Moreover, even when the yarn feeder is on the trailing side of the center, if the yarn feeder is set at a point lower than the conventional one, a satisfactory yarn feeding condition can be ensured. In the modification, the H presser and the concaves formed in the stitch cams are made to work together to guide the slider butt into the bypass, guidance of the slider butt into the bypass is not limited to this, and modification can be made in various ways.

I claim:

1. A flat knitting machine wherein at least a pair of needle beds are arranged to oppose each other with a trick gap between them and each needle bed has compound needles, each comprising: a slider having two blades with tongues formed at a head thereof and a slider butt; and a needle body having a hook at a head thereof and a needle body butt, wherein said compound needles are arranged in such a way that said slider and said needle body are moved independently of each other forward and backward, wherein said needle body and said slider have inactive positions on the needle bed, wherein the slider is controlled with combination of said slider butt and a slider cam lock provided on a carriage reciprocating over said needle beds, wherein the needle body is controlled with combination of said needle body butt and a needle body cam lock, and wherein said slider cam lock and said needle body cam lock are arranged symmetrically about a center of each cam lock, said flat knitting machine characterized in that said slider cam lock guides the slider into a tuck route, a knit route branching from the tuck route toward the trick gap outside the center of the cam lock, and a transfer route branching from the knit route toward the trick gap at the center of the cam lock selectively, that a first movable cam is provided at the center of the slider cam lock for controlling the branch to the knit route and to the transfer route, that said needle body cam lock is provided with a raising cam located at the center back of the cam lock and making the needle body move toward the trick gap, a second movable cam located at the front center of the raising cam, a bridge cam located in the front of the raising cam and on both sides of the second movable cam and making the needle body retract from the trick gap, and a pair of stitch cams located on both outer sides of the bridge cam and making the needle body retract from the trick gap, that said needle body cam lock guides the needle body to the tuck route guiding the needle body, outside the center of the cam lock, to a tuck level being closer to the trick gap than to the inactive position of said needle body, and next guiding the needle body substantially linearly to the stitch cam, the knit route branching from the tuck route after the tuck level being reached, guiding the needle body to a knit level being closer to the trick gap than the tuck level, retracting the needle body from the trick gap outside the center of the cam lock, and joining the tuck route, the transfer route branching near a joining point of the knit route and the tuck route, and retracting the needle body, having passed through the knit route, to a level between the inactive position of said needle body and the tuck level, and a receiving route extending from the center of the raising cam toward the trick gap and joining the tuck route, that said second movable cam controls branching to the transfer route, and that is provided a means for controlling the branch from the tuck route to the knit route.

2. A flat knitting machine of claim 1 characterized in that a selection jack having a selection jack butt is provided at a back of the needle body butt of said needle body, that is provided a presser pressing the selection jack butt and sinking the needle body and the slider into the needle bed for undoing their engagements with said slider cam lock and said needle body cam lock, and that said presser is provided with a first presser preventing the needle body from entering into the knit route and making the needle body run the tuck route, a second presser making the needle body having been retracted to the level between the inactive position and the tuck level, run at the same level, and a third presser guiding the needle body to the center of the raising cam.

3. A flat knitting machine of claim 2 characterized in that said first movable cam and said second movable cam are retractable.

4. A flat knitting machine of claim 3 characterized in that said raising cam is provided with a first guide face guiding the needle body to the tuck level, a second guide face guiding, in succession to the first guide face, the needle body to the tuck level, and a third guide face guiding the needle body in the receiving route, that the first guide face and the third guide face are set at a same height higher than the second guide face, and that a bottom of the receiving route facing the third guide face is set substantially at a same height as the second guide face.

5. A flat knitting machine of claim 1 characterized in that said slider cam lock is provided with a bypass route branching from the knit route and guiding the slider, at a level of the knit route, into a trailing cam lock.

* * * * *